United States Patent [19]

Lucas

[11] Patent Number: 4,537,546

[45] Date of Patent: Aug. 27, 1985

[54] BOOKBINDING DEVICE

[76] Inventor: Robert L. Lucas, 679 Sanchez St., San Francisco, Calif. 94114

[21] Appl. No.: 516,703

[22] Filed: Jul. 25, 1983

[51] Int. Cl.[3] ..... B42C 13/04

[52] U.S. Cl. ..... 412/10; 269/25; 412/902

[58] Field of Search ..... 29/251; 269/25; 412/10, 412/9, 902; 281/29

[56] References Cited

U.S. PATENT DOCUMENTS

| | | | |
|---|---|---|---|
| 1,590,918 | 6/1926 | Tindell | 29/251 |
| 2,170,301 | 8/1939 | Harry | 412/10 |
| 2,174,041 | 9/1939 | Pratt | 412/10 |
| 2,653,378 | 9/1953 | Esak | 269/25 X |
| 3,548,431 | 12/1970 | Hall et al. | 281/29 X |
| 3,995,361 | 12/1976 | Scheller et al. | 29/251 |

*Primary Examiner*—Paul A. Bell

[57] ABSTRACT

A combination bookbinding apparatus which can be used as a sewing frame, or a lying press, or a standing press wherein only its position on a table or work surface determines its function. All parts are in place at once and no alteration to the device is needed to effect a change in function. The device is automotive and leaves the hands free for the manipulation of the book(s) preparatory to the clamping or pressing operations.

4 Claims, 2 Drawing Figures

BOOKBINDING DEVICE

BACKGROUND

In the field of hand bookbinding and repair, there has been for centuries a constant and generally unimproved set of equipment dedicated to the following functions: (a) the clamping of books during certain phases of work, (b) the pressing of books during other phases of work, and (c) the holding of books and securing media during the sewing phase of work.

The equipment for function (a) is currently known as a lying press, for function (b) a standing press, and for function (c) a sewing frame. In general, all equipment has been operated by the manual turning of one or two screws or nuts.

With the advent of the machine-made book, all three pieces of equipment were phased out of the mass production of books. There remain, however, many binderies as well as restoration centers which demand the use of handwork on books and therefore the employment of the said equipment.

When working on a single book, no more than one piece of said equipment need be used at a time. It follows, therefore, that a multiple-service or combination device capable of all three functions could save both space and capital expenses even when several devices are used at once.

BRIEF SUMMARY

This invention comprises a single device which can function as a sewing frame, or a lying press or a standing press with all parts in place at once.

It can be powered by an appropriate means for opening and closing or raising and lowering its elements. Opened and closed horizontally, it can be used as a lying press. Opened and closed vertically, it can be used as a standing press. Opened in a vertical position, it can be used as a sewing frame. Only its position on a table or work surface determines its function. Paraphanalia ordinarily used with presses and sewing frames are also used with this device.

Provided with a foot switch or other means of control, the device can be operated while both hands are left free to manipulate the book(s) to be clamped or pressed (often a very difficult manipulation with prior art where only one hand is used to grasp the book while the other turns a tightening screw.

DETAILED DESCRIPTION

Figure 1:
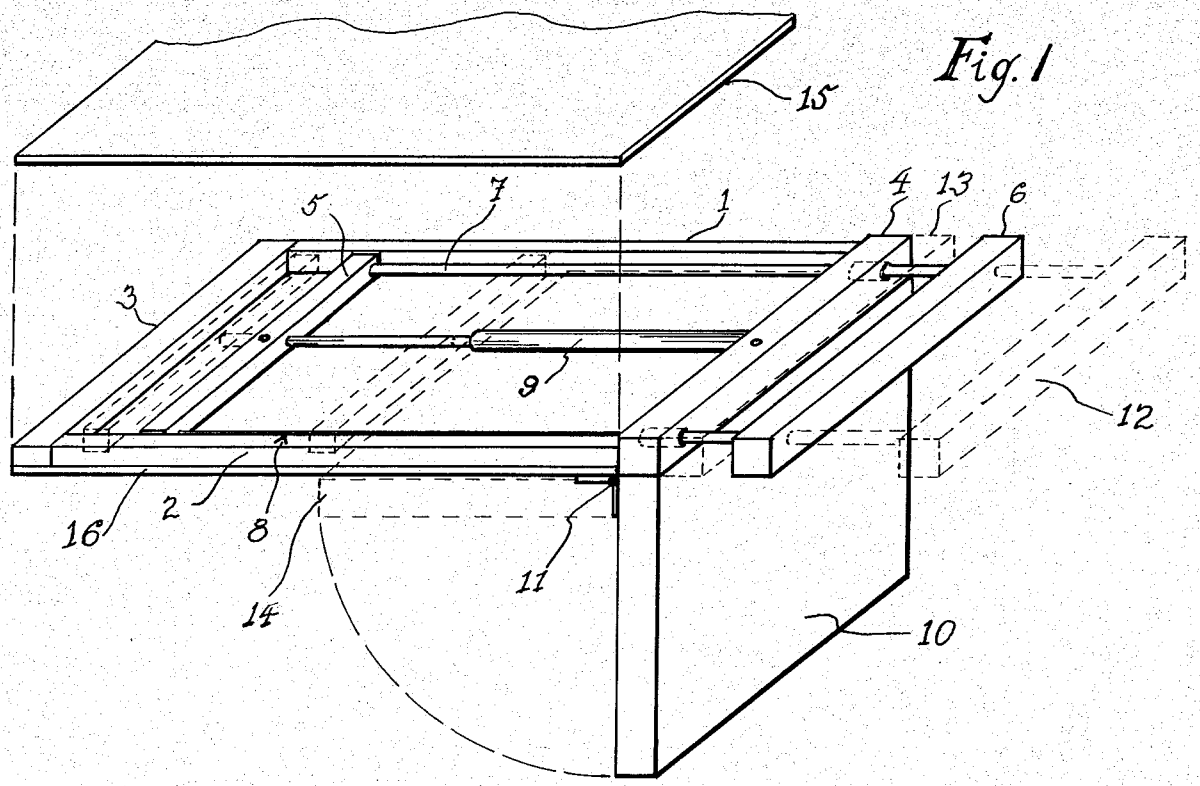
FIG. 1 is an isometric top and side view of the device with the top cover removed. It is shown in three positions of movement and in a working and carrying or storage condition.

FIG. 1 shows the essential parts of the device: A frame or enclosure is made of enclosure rails 1 and 2, end piece 3, and stationary press-cheek clamping surface 4. Travelling beam 5 is hinged to a movable press-cheek or clamping surface 6 through connecting rods 7 and 8. A means 9 for pushing and pulling elements 5 and 6 towards or away from element 4 is anchored to stationary clamping surface 4 at one end and to travelling beam 5 at the other end. An open flap 10 is hinged to the frame near the stationary clamping surface 4 at 11 and hangs over the edge of a table or work surface as shown in FIGS. 2–3 or rests on the said table as in FIGS. 2–1 and 2—2.

Figure 2:
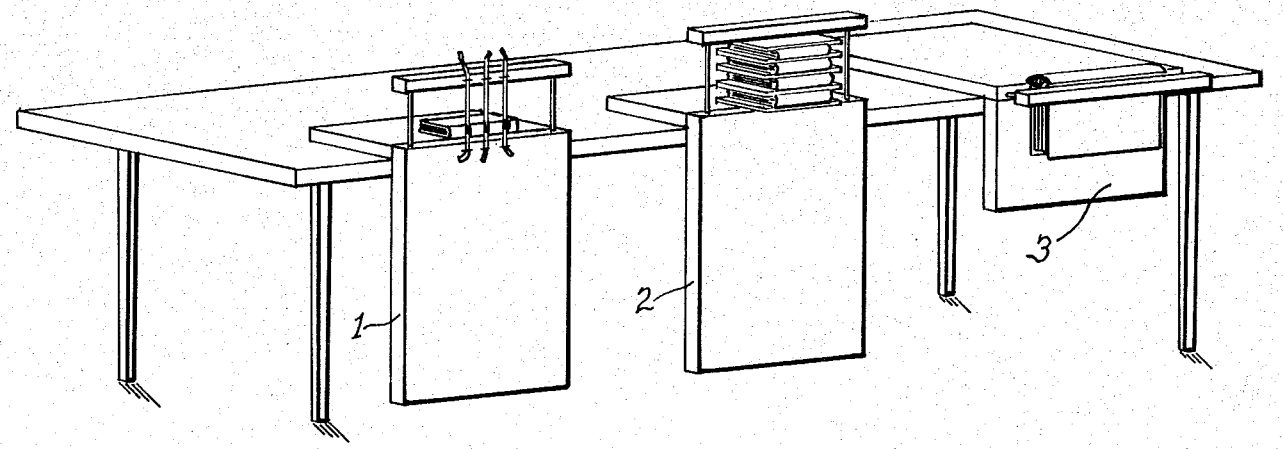
FIG. 2 is an isometric top and side view of a table or work surface on which are shown three of the subject devices, each being used for a different one of the three heretofore mentioned functions common to hand bookbinding: (1) sewing a book(s), (2) pressing several books at once, and (3) clamping a book during work on it.

When the means 9 pushes element 5 away from element 4, element 6 moves towards element 4 and presses or clamps books as shown in FIGS. 2—2 and 2–3, or releases tapes or cords in the sewing frame mode shown in FIG. 2–1. When the means 9 pulls element 5 towards element 4, element 6 moves away from element 4 and releases books being pressed or clamped as shown in FIGS. 2—2 and 2–3, or tightens tapes or cords in the sewing frame mode shown in FIG. 2–1.

The movable press-cheek 6 is shown fully opened at 12 and fully closed at 13. The flap 10 is shown in a carrying or storage position at 14. Covers 15 and 16 for said frame are shown attached to the frame as shown in FIG. 1.

A typical means of pushing or pulling (9) is an electrically driven rack and pinion combination or a pneumatic or hydraulic double-acting actuator as shown in FIG. 1 (a piston and cylinder combination). Linear motors or rotary motors in conjunction with gears, levers, pulleys and connectives are among many powering devices which could be used for such means.

I claim:

1. A bookbinding apparatus for use in performing several different binding operations comprising:

an elongated frame having two ends and two sides, one of said ends comprising a first, fixed, clamping surface which surface extends generally perpendicular to the longitudinal axis of said frame;

first means comprising a second, movable, clamping surface, said means being mounted to said frame by second means which permits the first means to be moved along the longitudinal axis of said frame from a first, open, position to a second, clamping, position whereby a book may be clamped between said two surfaces;

a flap hinged to said frame near said one end so as to pivot between an open position generally perpendicular to said longitudinal axis of said frame and a closed position generally parallel to said axis;

whereby said apparatus may be supported for use in a bookbinding operation near the edge of a work surface with either the frame or the flap resting on said surface.

2. A bookbinding apparatus as in claim 1 wherein the second means comprises a movable beam guided for motion along the longitudinal axis of said frame and connecting rod means fixed at one end to the movable beam and fixed at the other end to said first means; said second means further comprising actuator means connected to said frame and to said movable beam so as to reciprocate said movable beam along the longitudinal axis of said frame.

3. A bookbinding apparatus as in claim 2 wherein the actuator means is selected from the group consisting of a rack and pinion means, a pneumatic actuator, a hydraulic actuator or a linear motor.

4. A bookbinding apparatus as in claim 1 wherein cover means are provided to enclose said frame.

* * * * *